United States Patent [19]

Hope et al.

[11] 3,965,758

[45] June 29, 1976

[54] CONTROLLABLE PUMPS

[76] Inventors: Henry F. Hope; Stephen F. Hope, both of 2548 Wyandotte Road, Willow Grove, Pa. 19090

[22] Filed: Nov. 1, 1974

[21] Appl. No.: 520,009

[52] U.S. Cl. ..... 74/41; 92/13.3

[51] Int. Cl.[2] ..... F16H 21/32; F01B 31/14

[58] Field of Search ..... 74/41, 43; 417/426, 417/137, 385, 539; 92/13.3, 13.5, 13.7, 13.2, 68

[56] References Cited

UNITED STATES PATENTS

| | | | |
|---|---|---|---|
| 1,915,827 | 6/1933 | Kickler | 92/13.3 X |
| 2,548,807 | 4/1951 | Morgan et al. | 74/41 X |
| 2,841,991 | 7/1958 | Saalfrank | 92/13.7 X |
| 2,958,237 | 11/1960 | Johnson | 74/41 X |
| 3,612,732 | 10/1971 | Stephans | 417/426 X |
| 3,871,268 | 3/1975 | Misima | 92/13.3 |

*Primary Examiner*—Benjamin W. Wyche
*Assistant Examiner*—Lance W. Chandler
*Attorney, Agent, or Firm*—Weiser, Stapler & Spivak

[57] ABSTRACT

Two or more reciprocating pumps are controlled to deliver fluids in adjustable proportions. The pumps are connected to respective actuating levers. Each lever is reciprocated about a pivot, whose position along the lever is adjustable to vary the stroke length of the pump connected to that lever. By so controlling the stroke lengths of the different pumps, the proportions in which they deliver fluids can be adjusted.

19 Claims, 6 Drawing Figures

CONTROLLABLE PUMPS

BACKGROUND OF THE INVENTION

This invention relates to the control of reciprocating devices, such as pumps. It is often desirable to use a plurality of reciprocating pumps in such a way that their respective rates of fluid delivery are easily and reliably controllable, both individually and relative to each other. For example, in chemical processes it is often desired to delivery several fluid ingredients in relatively adjustable proportions. As another example, in hospitals, chemicals are frequently used in water solutions. Such solutions are not infrequently of very low concentration, e.g. 2% of the chemical to 98% water. Because it has been difficult heretofore to achieve on-the-spot mixing of such solutions in the required proportions, it has been the practice to purchase and store them ready mixed. Even in the minimum quantities needed for a reliable emergency supply, such solutions, by virtue of their low concentrations, required large storage volumes. This would have been greatly reduced if it had been practical to store only the pure chemical in liquid form and combine it only as consumed in the desired proportions with water, which is available at anytime in essentially unlimited quantities from the water supply.

Prior attempts to provide controllable pumps suitable for such purposes have been largely unsuccessful, because they have been based on technical approaches which were too complicated, too costly, and in some cases even too unreliable for the particular application.

BRIEF DESCRIPTION OF THE INVENTION

Accordingly, it is a primary object of this invention to provide a system of reciprocating pumps which overcomes the limitations discussed above.

It is another object to provide a control system for reciprocating pumps which permits convenient adjustment of their relative effective capacities.

It is still another object to provide a system of reciprocating pumps whose relative liquid delivery rates are adjustable readily and in a calibrated manner.

It is a further object to provide such a system of pumps in which both the actuating and the control mechanism is simple, inexpensive, and reliable.

It is yet another object to provide a control system for controlling the stroke of reciprocating devices, such as pumps, in simple and inexpensive manner.

These, and other objects of the invention which will appear, are achieved in accordance with the invention, by driving the reciprocating member of each of a plurality of reciprocating pumps from an intermediate point on a lever. One end of this lever is subjected to a uniform reciprocating movement, while the other end is pivoted in such a manner that the pivot can be controllably displaced lengthwise of the lever. Such lengthwise movement of the pivot changes the reciprocating displacement of the intermediate point on the lever to which the reciprocating pump member is attached, and thereby also the length of the pump stroke. The uniformly reciprocating ends of the several levers are preferably all connected together, so as to be subjected to their reciprocating movements in unison, e.g. by a single motor turning a crank whose arm is connected to a shaft on which pivot the ends of all of these levers.

DETAILED DESCRIPTION

Figure 1:
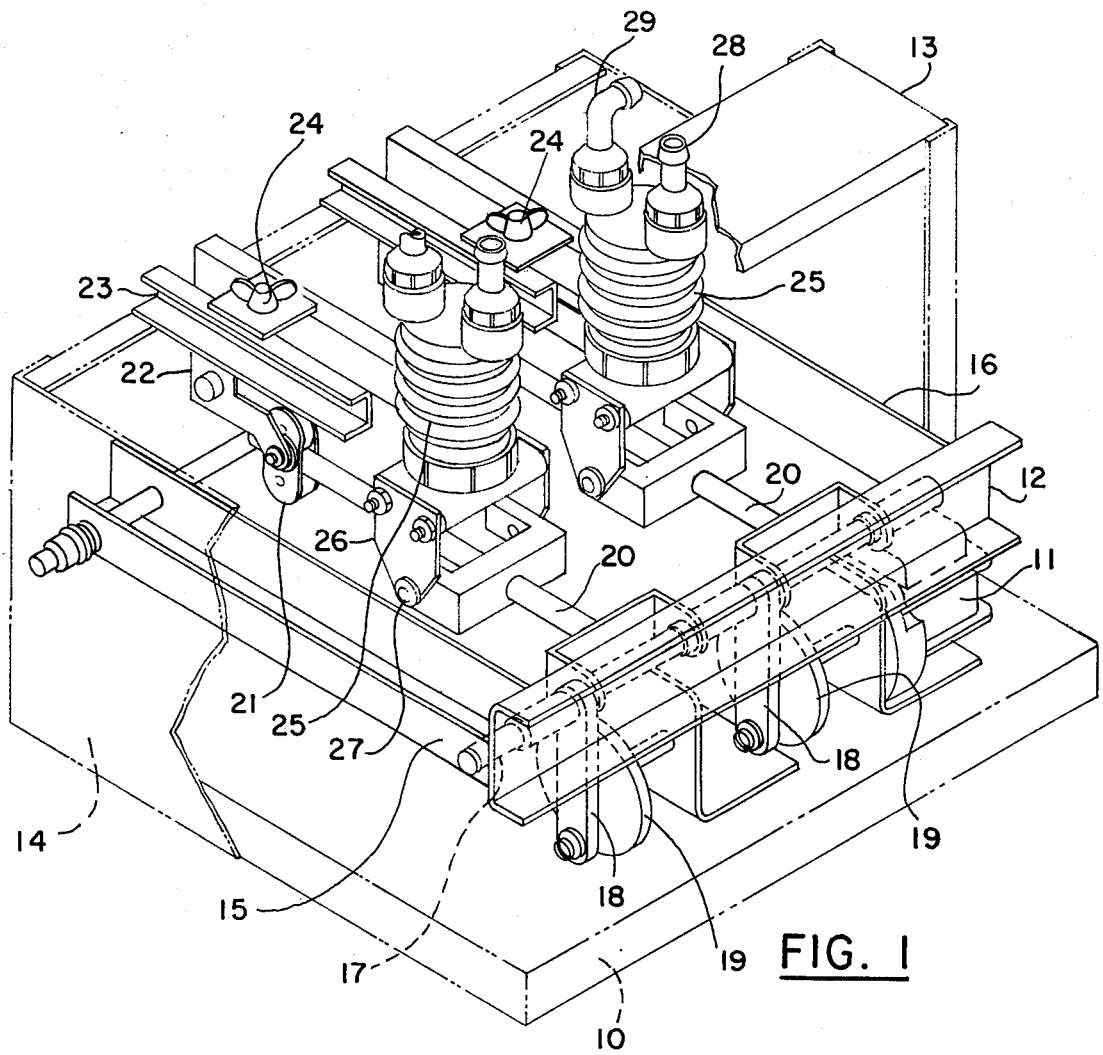
Figure 4A:
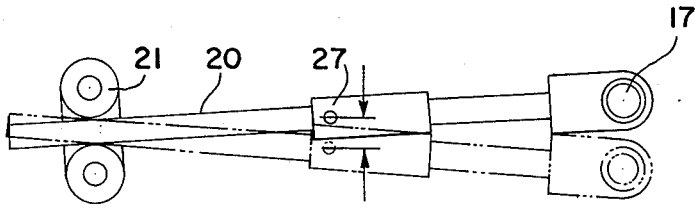
Figure 4B:
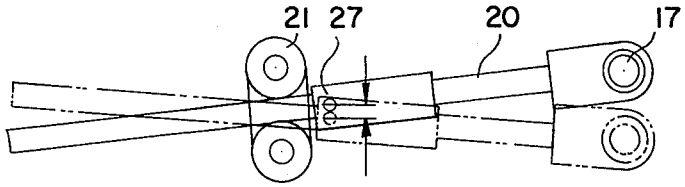
Figure 2:
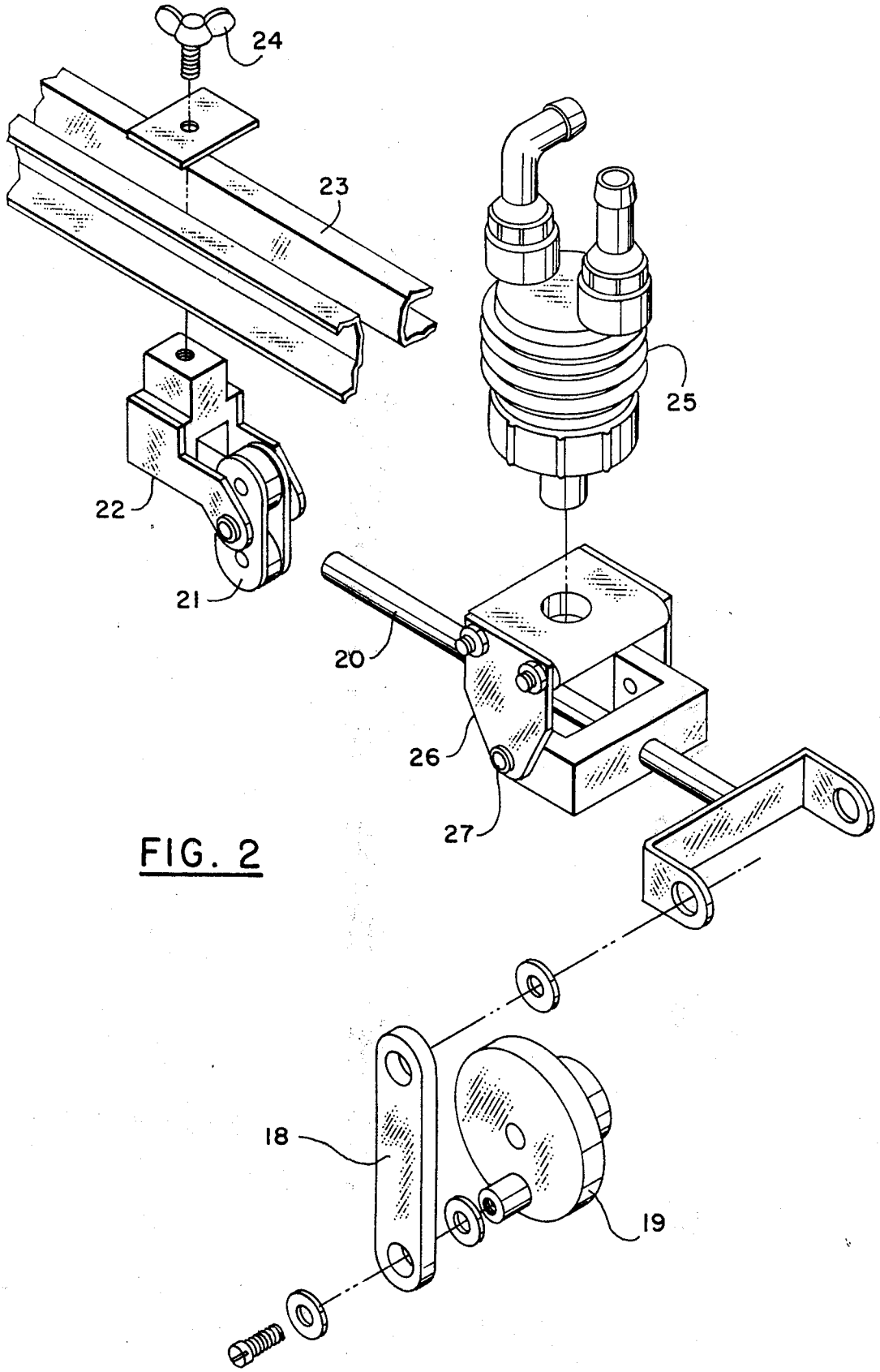
Figure 3B:
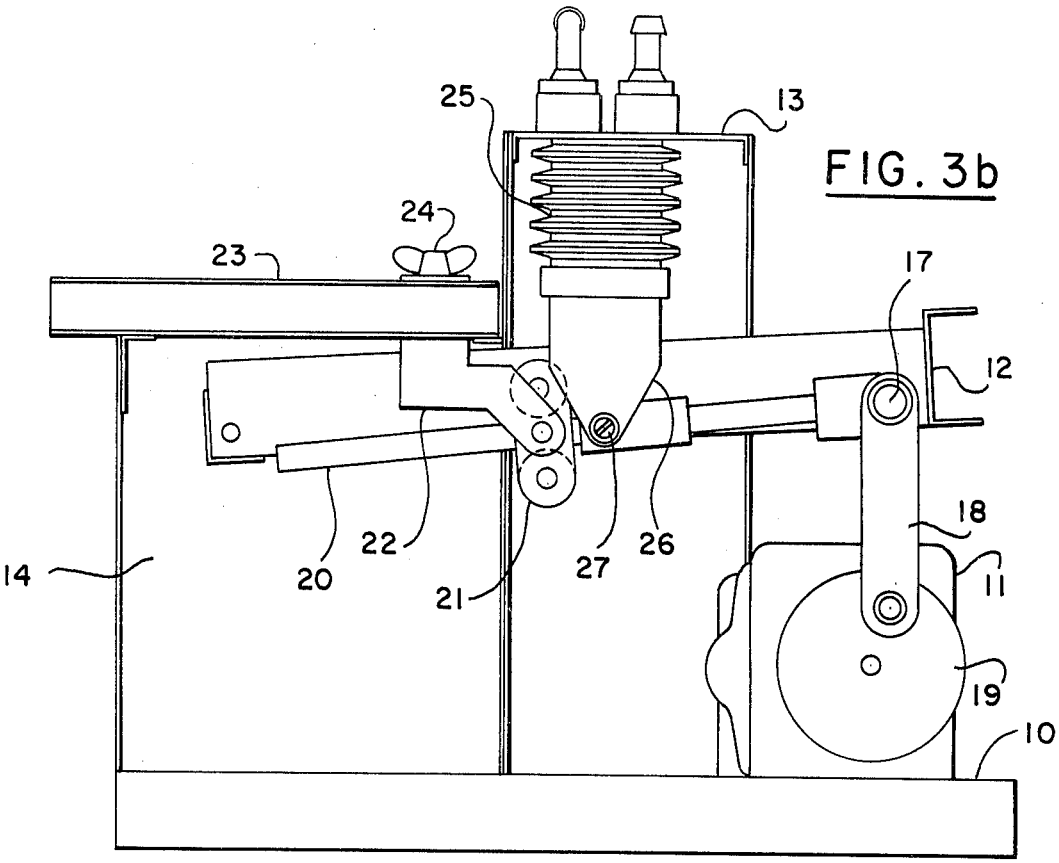
Figure 3A:
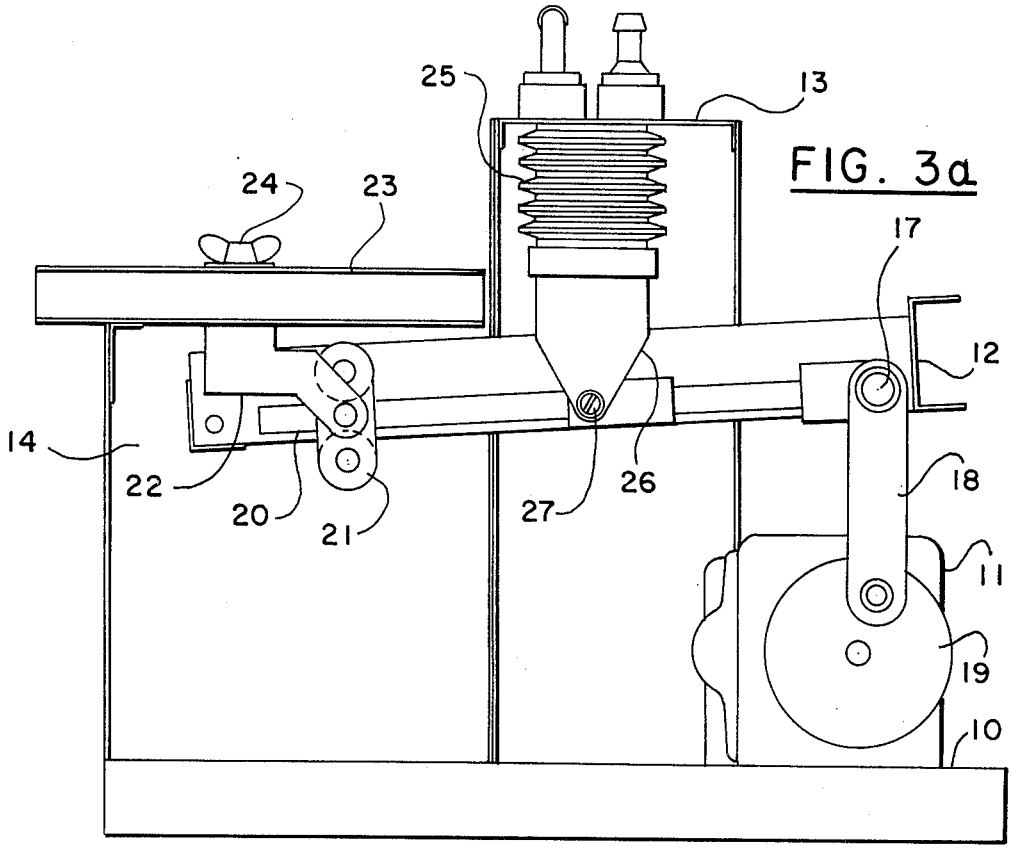

For further details, reference is made to the discussion which follows, in the light of the accompanying drawings, wherein FIG. 1 is an isometric view of a preferred embodiment of the invention;

FIG. 2 is an exploded view of portions of the embodiment of FIG. 1, showing one of the pumps forming part of that embodiment and its associated driving and control elements;

FIGS. 3*a* and 3*b*, respectively, are cross-sectional views taken along A—A in FIG. 1, and showing the adjustment of any one pump stroke, respectively; and FIGS. 4*a* and 4*b*, respectively, are diagrammatic illustrations of the stroke adjustments of FIGS. 3*a* and 3*b*.

The same elements are designated by the same reference numerals in the various Figures.

The overall system illustrated in FIG. 1, to which reference may now be had, along with the exploded view of FIG. 2, includes a mounting base 10, supporting an electric motor 11 and three mounting frames 12, 13 and 14. For convenient reference, mounting frame 12, which is closest to motor 11, will be referred to as the front mounting frame, frame 14, which is farthest from the motor, will be referred to as the rear mounting frame, and frame 13 located between the other two frames will be referred to as the middle mounting frame.

Front mounting frame 12 is attached at either end to rear mounting frame 14 by connecting straps 15, 16, rigidly attached at the opposite ends of front mounting frame 12 and pivotally attached at opposite ends of rear mounting frame 14. Also extending between connecting straps 15 and 16 adjacent front mounting frame 12 is a shaft 17 to which is pivotally attached one end of crank arm 18, the other end of which is excentrically driven by the flywheel 19 of motor 11. Also pivotally attached to shaft 17 is a plurality of levers 20, each being preferably so attached by means of a yoke as shown in FIG. 1.

Near the end of each lever 20 opposite to that at which it is pivotally attached to shaft 17, each such lever is retained in roller assembly 21 formed of a pair of rollers and a bracket holding them spaced by a distance sufficient to accommodate the passage of lever 20 between them. Each roller assembly 21, in turn, is attached by means of a bracket 22 to a track 23, which extends from middle mounting frame 13 to rear mounting frame 14. As shown in FIGS. 1 and 2, bracket 22 is constructed to be slidable along track 23 and is further provided with an arrangement, which may take the form of wing bolt 24, for fixing at will the position of bracket 22 along track 23. Attached to middle mounting frame 13 is a plurality of reciprocating pumps 25, each preferably positioned above a corresponding one of levers 20. As shown in FIGS. 1 and 2, these reciprocating pumps 25 are of the bellows type but it will be understood that any other type of pump may be used. The reciprocating drive member 26 of each pump 25 is pivotally attached to the respective lever 20 at 27, preferably by a yoke arrangement as shown in FIGS. 1 and 2.

In operation, motor 11 is energized in conventional manner. As it rotates, it causes flywheel 19 to rotate, thereby causing crank 18 to raise and lower in reciprocating movement front mounting frame 12 and shaft 17. The ends of levers 20 which are attached to shaft 17 are correspondingly raised and lowered in reciprocating movement. Near the opposite end of each lever 20, the respective roller assembly 21 clamping that portion of the lever forms a pivot during reciprocating up and down movement of the lever end attached to shaft 17. By adjustment of bracket 22 along track 23 at varying positions between middle and rear mounting frames 13 and 14, the position of this pivot along each lever 20 can be correspondingly adjusted.

FIGS. 3*a* and 3*b*, to which reference may now be had, show how the stroke of pump 25 attached to any given lever 20 is effected by such adjustment of the pivot formed by roller assembly 21, FIG. 3*a* being for the long-stroke adjustment and FIG. 3*b* for the short-stroke adjustment. FIGS. 4*a* and 4*b* show these same adjustments diagrammatically. Specifically, FIG. 4*a* shows the two extreme positions assumed by lever 20 at opposite extremes of the stroke of crank arm 18 when the roller assembly is positioned relatively close to the adjacent end of lever 20. The uppermost position assumed by lever 20 under these circumstances is shown in solid lines in FIG. 4*a*, whereas the lowermost position is shown in broken lines.

FIG. 4*b*, in contrast, shows the extreme positions assumed by lever 20 when the pivot formed by roller assembly 21 is moved farther away than in FIG. 4*a* from its adjacent end of lever 20. Again, the uppermost position assumed by lever 20, under these circumstances, is shown in solid lines in FIG. 4*b*, and the lowermost position in broken lines. By comparison of FIGS. 4*a* and 4*b* it is apparent that the excursion of lever 20 for these two adjustments of pivot position is materially different. In particular, the pivotal attachment 27 moves through a considerably greater vertical distance in FIG. 4*a* than in FIG. 4*b*. Correspondingly, the stroke of pump 25 attached to lever 20 under the respective conditions of FIGS. 4*a* and 4*b* will be materially different, that stroke being appreciably longer for the conditions of FIG. 4*a* than for those of FIG. 4*b*.

Thus, for each of the plurality of pumps 25, the length of stroke and therefore the pump's liquid handling capacity, can be adjusted by adjustment of the position of roller assembly 21 along lever 20, through sliding movement of bracket 22 along track 23. Each track can readily be calibrated in terms of pump delivery capacity. Moreover, if the pumps are substantially the same in physical characteristics, then proportions of pump delivery rates can readily be established by relative displacements of the respective brackets 22 along the different tracks 23.

While only two pumps have been shown in FIG. 1, it will be understood that a greater number can readily be controlled and operated by the same system.

It will be understood that, in any practical application of the equipment, the inlet and outlet orifices 28, 29 of each pump 25 will be connected to appropriate sources and points of utilization of the liquid being pumped thereby. However, these form no specific part of the present invention, and are therefore not further illustrated or discussed herein.

It will also be noted that the use of a roller assembly to provide the pivot near the free end of each lever 20 permits ready adjustment of the location of that pivot, even while the equipment is in motion. Furthermore, it makes it possible for that end of that lever to not only pivot, but also slide forward and backward during reciprocatory movement of the system to the extent this is necessitated by the up and down movement of the attached end of the lever. However, other pivot arrangements, such as a sleeve without rollers, may likewise be used to provide this pivot. Other modifications will also occur to those skilled in the art without departing from the inventive concept.

We claim:

1. In a system for simultaneously reciprocating with controllable stroke lengths a plurality of reciprocable devices:

a plurality of levers for respectively activating the different ones of said reciprocable devices;

means connecting together one end of each said lever for simultaneous reciprocating movement thereof; and means providing a separate pivot for a portion of each said lever distant from said connected-together end, each pivot means being separately adjustable in position lengthwise of its lever, and each lever having attached to it, between its said connected-together end and adjustable pivot, means for activating the stroke of a respective one of said reciprocating devices.

2. The system of claim 1, wherein each said pivot means includes means providing a passage within which said lever can move lengthwise while being caused to pivot by said reciprocating movement of its connected-together end.

3. The system of claim 2, wherein said passage-providing means is a pair of rollers located on opposite sides of said lever in the direction of pivoting.

4. The system of claim 3, wherein said rollers are pivotally mounted for pivoting in the same plane as said lever.

5. The system of claim 1, wherein said connected-together lever ends are also attached pivotally to said connecting means.

6. The system of claim 1, wherein each of said devices is a reciprocating pump, and each of said activating means is the piston rod of one said pump.

7. The system of claim 6, wherein each said piston rod is attached pivotally to a fixed point on its respective lever.

8. The system of claim 1, wherein said connecting-together means is reciprocated by a motor-driven crank.

9. The system of claim 4, wherein each said roller pair is movable lengthwise along its respective lever while said lever is reciprocating.

10. The system of claim 9, comprising means for fixedly positioning said roller pair lengthwise along the respective lever.

11. The system of claim 9, wherein the position of said roller pair positioning means is calibrated in pump capacity.

12. A system for delivering fluids at controllable rates comprising:

a plurality of reciprocating pumps having variable stroke lengths;

a plurality of actuating levers respectively connected to the different pumps;

means for reciprocating each lever;

separate pivot means for each lever independently adjustable along each lever to vary its stroke length, thereby independently controlling the fluid delivery rates of the respective pumps; and the levers being connected to said pumps between the reciprocating means and the pivot means.

13. The system of claim 12 wherein each pivot means comprises a pair of rollers.

14. The system of claim 13 wherein each pair of rollers is movable along its lever while the lever is reciprocating.

15. The system of claim 12 wherein said reciprocating means includes a crank connected to all the levers and a motor for turning the crank.

16. The system of claim 15 wherein the crank is connected to all the levers by the cross-bar of a U-shaped yoke.

17. The system of claim 16 wherein each lever is pivotally connected to the yoke cross-bar.

18. The system of claim 17 wherein the ends of the U-shaped yoke are attached to pivots.

19. The system of claim 18 wherein the pivots for the yoke, the pivots for levers, and the motor are all mounted on a common frame.

* * * * *